US005183634A

United States Patent [19]

Abe et al.

[11] Patent Number: 5,183,634

[45] Date of Patent: Feb. 2, 1993

[54] HIGH STRENGTH SPRING STEEL

[75] Inventors: Tsuyoshi Abe, Chiba; Nobumasa Umezawa, Funabashi; Tatsuo Fukuzumi, Tokyo; Katsuyuki Uchibori, Chiba; Junji Ozaki, Tokyo; Hiroharu Motomura, Ichihara, all of Japan

[73] Assignee: Mitsubishi Steel Mfg. Co., Ltd., Tokyo, Japan

[21] Appl. No.: 805,202

[22] Filed: Dec. 9, 1991

[30] Foreign Application Priority Data

Feb. 22, 1991 [JP] Japan ..... 3-48766
Jun. 19, 1991 [JP] Japan ..... 3-147460

[51] Int. Cl.[5] ..... C22C 38/22; C22C 38/24
[52] U.S. Cl. ..... 420/110; 148/908
[58] Field of Search ..... 420/110; 148/908

[56] References Cited

U.S. PATENT DOCUMENTS 5,118,469 6/1992 Abe et al. ..... 148/908

FOREIGN PATENT DOCUMENTS 3130914 6/1982 Fed. Rep. of Germany ..... 148/908
58-27957 2/1983 Japan ..... 148/908
58-27959 2/1983 Japan ..... 148/908

*Primary Examiner*—Deborah Yee
*Attorney, Agent, or Firm*—Flynn, Thiel, Boutell & Tanis

[57] ABSTRACT

Disclosed is a high strength spring steel consisting of, in weight percentage, 0.50 to 0.70% C, 1.00 to 2.50% Si, 0.30 to 1.20% Mn, 0.80 to less than 1.20% Cr, 0.05 to 0.3% Mo, 0.05 to 0.30% V, 0.01 to 0.30% Nb, 0.005 to 0.100% Al and the balance being Fe and unavoidable impurities. The steel of the present invention has a high hardness coupled with high toughness and is very useful, especially for springs used in suspension devices or other various industrial machines.

1 Claim, 1 Drawing Sheet

HIGH STRENGTH SPRING STEEL

BACKGROUND OF THE INVENTION

1. Field of the Invention

This invention relates to a high strength spring steel useful in cars, aircraft, various industrial machines, etc.

2. Description of the Prior Art

In recent years, weight reduction has been strongly demanded in cars for lowering the cost of fuel. The same demand has also been growing in various structural parts or members including suspension devices. One possible approach for the reduction of weight of suspension devices is to increase the designed stress of suspension springs. In other words, strengthening the springs is effective as a weight-reducing measure. Currently, Si-Mn type steel, designated SUP 7, and Si-Cr type steel, designated SUP 12, are mainly used as steel stock for suspension springs. In order to increase the designed stress of these known spring steels, it is necessary to strengthen them. In general, the strength of steel materials is closely correlated with their hardness and strengthening means increasing the hardness. However, there is a problem that when the hardness of the spring steels is increased, the toughness (Charpy impact values, etc.) is also reduced. More specifically, a reduction in toughness is unavoidable in obtaining a hardness higher than that may be achieved in spring steels in current use. Therefore, when the hardness is increased for the purpose of improving the strength, the toughness must also be higher than that of currently available steels to ensure a sufficient reliability.

SUMMARY OF THE INVENTION

It is an object of the present invention to provide a high strength spring steel which has higher strength and toughness than spring steels currently used.

The influences of various elements on the hardness and toughness of spring steels were studied by the present inventors and the following equations were obtained. Percentages (%) of the respective elements shown in the equations are by weight.

When the Mn content is in the range of 0.30 to less than 0.50%, $$\text{Hardness (Hv)} = 390.5 + 158.6\,(C\,\%) + 50.5\,(Si\,\%) + 2.862\,(Mn\,\%) + 21.64\,(Cr\,\%) + 71.45\,(Mo\,\%) + 73.03\,(V\,\%) + 82.08\,(Nb\,\%) + 79.09\,(Al\,\%) \quad \text{(multiple correlation coefficient } R = 0.972) \qquad \text{Equation (1a)}$$

$$\text{Toughness (Charpy impact value Cp, kgf-m/cm}^2\text{, for test pieces with 2 mm long U-shaped notches specified in JIS No. 3)} = 6.772 - 6.104\,(C\,\%) - 0.025\,(Si\,\%) - 0.511\,(Mn\,\%) - 0.038\,(Cr\,\%) + 2.394\,(Mo\,\%) + 1.033\,(V\,\%) - 1.343\,(Nb\,\%) + 9.098\,(Al\,\%) \quad \text{(multiple correlation coefficient } R = 0.833). \qquad \text{Equation (2a)}$$

The above relations are applicable to a sample steel which has been subjected to a sufficient martensitic transformation by quenching and then tempered at 400 ° C.

From the above result, it has been found that alloying elements are very closely related to the properties of hardness and toughness. In detail, it has been found that an increased hardness can be achieved by controlling the alloying elements C, Si, Mn, Cr, Mo, V, Nb and Al and a high toughness can be achieved by controlling alloying elements of Mo, V and Nb.

When the Mn content is in the range of 0.50 to 1.20%, $$\text{Hardness (Hv)} = 460 + 112.6\,(C\,\%) + 46.82\,(Si\,\%) + 4.581\,(Mn\,\%) + 21.11\,(Cr\,\%) + 14.20\,(Mo\,\%) + 172.2\,(V\,\%) - 158.0\,(Nb\,\%) - 122.3\,(Al\,\%) \quad \text{(multiple correlation coefficient } R = 0.956) \qquad \text{Equation (1b)}$$

$$\text{Toughness (Charpy impact value Cp, kgf-m/cm}^2\text{, for test pieces with 2 mm long U-shaped notches specified in JIS No. 3)} = 2.297 - 1.166\,(C\,\%) + 0.504\,(Si\,\%) - 0.130\,(Mn\,\%) + 0.505\,(Cr\,\%) + 1.904\,(Mo\,\%) + 1.260\,(V\,\%) + 3.993\,(Nb\,\%) + 9.643\,(Al\,\%) \quad \text{(multiple correlation coefficient } R = 0.894). \qquad \text{Equation (2b)}$$

The above relations are applicable to a sample steel which has been subjected to a sufficient martensitic transformation by quenching and then tempered at 380° C.

From the above result, it has been found that alloying elements are very closely related to properties of hardness and toughness. In detail, it has been found that an increased hardness can be achieved by controlling alloying elements C, Si, Mn, Cr, Mo and V to certain amounts and high toughness can be achieved by controlling alloying elements of Si, Cr, Mo, V, Nb and Al to certain content levels.

On the basis of such findings, there can be obtained high-strength spring steels having both high hardness and high toughness and the present invention could be accomplished.

According to the present invention, there is provided a high strength spring steel consisting of, in weight percentage, 0.50 to 0.70% C, 1.00 to 2.50% Si, 0.30 to 1.20% Mn, 0.80 to less than 1.20% Cr, 0.05 to 0.30% Mo, 0.05 to 0.30% V, 0.01 to 0.30% Nb, 0.005 to 0.100% Al and the balance being Fe and unavoidable impurities.

BRIEF DESCRIPTIONS THE DRAWINGS

DETAILED DESCRIPTION OF THE PREFERRED EMBODIMENTS

Figure 1:
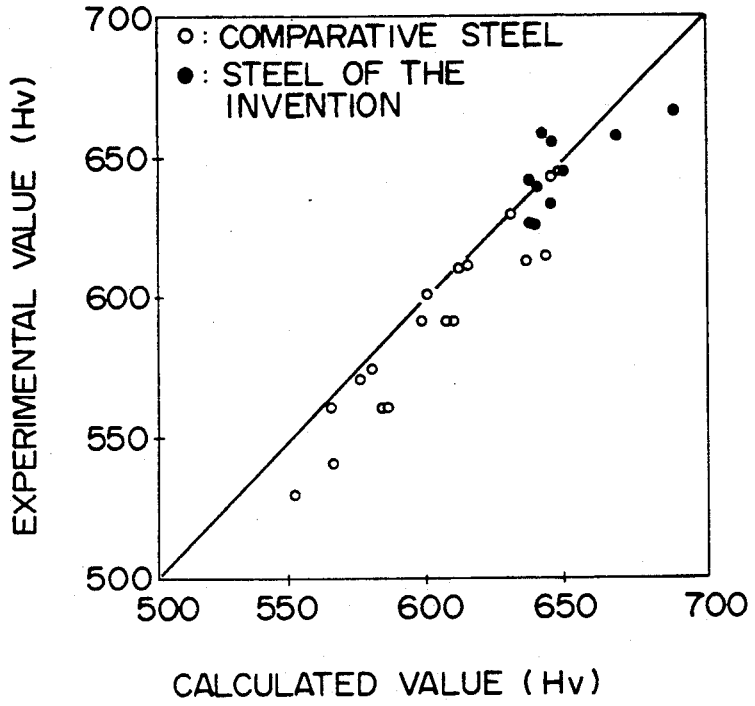
FIG. 1 is a graph showing the relationship between the calculated values and experimental values for the hardness of sample steels.

The components of the steel of the present invention are specified as above for the following reasons.

Carbon: C is an effective element to increase the strength of the steel. When its content is less than 0.50%, a strength adequate for springs can not be obtained. On the other hand, when carbon is present in excess of 0.70%, the resulting springs becomes too brittle. Therefore, the carbon content is limited to the range of 0.50 to 0.70%.

Silicon: Si dissolves in ferrite to form a solid solution and effectively acts for improving the strength of the steel. When the Si content is less than 1.00%, a strength sufficient for springs can not be ensured. An excessive content of Si of more than 2.50% tends to cause decarburization on the steel surface during hot-forming the steel into a spring and hence to detrimentally affect the durability of the spring. Therefore, the content of Si is limited to the range of 1.00 to 2.50%.

Manganese: Mn is needed to improve the hardenability of the steel. The optimum Mn content range is from 0.30% to 1.20%.

Chromium: Cr is effective to strengthen the steel. When the Cr content is less than 0.80%, a strength adequate for springs can not be obtained. However, even if Cr is added in an excess amount of 1.20% or more, any further advantageous effect can not be obtained. Such an excess addition rather impairs the toughness. Therefore, the Cr content is limited within the range of 0.80 to less than 1.20%.

Molybdenum: Mo is an element which is required to ensure a sufficient hardenability and increase the strength and toughness of the steel. An amount of Mo of less than 0.05% can not sufficiently provide these effects, while an amount above 0.30% tends to produce precipitates of coarse carbides, impairing the spring properties. Therefore, the Mo content is limited within the range of 0.05% to 0.30%.

Vanadium: V also strengthens the steel. However, when the V content is less than 0.05%, a sufficient strengthening effect can not be expected. On the other hand, when the V content exceeds 0.30%, a substantial amount of carbides does not dissolve into austenite and, thereby, the spring characteristics are impaired. Thus, the V content range is limited to the range of 0.05 to 0.30%.

Niobium: Nb is an element which increases the strength and toughness of the steel due to its grain refinement function. When the content is less than 0.01%, the effect can not be sufficiently expected. On the other hand, when Nb is present in excess of 0.30%, the amount of carbides which do not dissolve into austenite increases and the spring characteristics are impaired. Accordingly, the content of Nb should be within the range of 0.01 to 0.30%. Aluminum: Al is needed for deoxidation and control of the austenite grain size. When Al is present in amounts less than 0.005%, grain refinement can not be expected. On the other hand, an excessive Al amount above 0.100% tends to reduce the castability. Thus, the content of Al should be in the range of 0.005 to 0.100%.

The spring steel of the present invention having the composition as specified above can be obtained through commonly practiced production steps, such as steelmaking; ingot-making or continuous casting; and blooming and rolling into a steel bar or wire rod. Thereafter, the steel is hot-formed into a coil spring and is subjected to aftertreatments, such as quenching, tempering, shot-peening and setting. In such a production process, a high strength coil spring can be obtained.

EXAMPLE 1

Table 1 shows the chemical compositions of the inventive sample steels and comparative sample steels.

TABLE 1

| Sample | Composition (wt. %) | | | | | | | | |
|---|---|---|---|---|---|---|---|---|---|
| No. | C | Si | Mn | Cr | Mo | V | Nb | Al | Fe |
| A1 | 0.55 | 1.49 | 0.61 | 0.86 | 0.11 | 0.19 | 0.026 | 0.048 | bal. |
| A2 | 0.55 | 2.02 | 0.69 | 0.87 | 0.11 | 0.20 | 0.023 | 0.038 | bal. |
| A3 | 0.53 | 2.46 | 0.68 | 0.86 | 0.27 | 0.20 | 0.024 | 0.032 | bal. |
| A4 | 0.53 | 1.51 | 0.72 | 0.83 | 0.05 | 0.20 | 0.022 | 0.038 | bal. |
| A5 | 0.58 | 1.29 | 0.69 | 0.85 | 0.15 | 0.20 | 0.022 | 0.044 | bal. |
| A6 | 0.52 | 1.51 | 0.69 | 0.84 | 0.19 | 0.20 | 0.024 | 0.043 | bal. |
| A7 | 0.52 | 1.58 | 0.65 | 0.85 | 0.11 | 0.20 | 0.023 | 0.024 | bal. |
| A8 | 0.58 | 1.52 | 0.67 | 0.84 | 0.10 | 0.20 | 0.024 | 0.029 | bal. |
| A9 | 0.57 | 1.44 | 0.81 | 0.83 | 0.10 | 0.19 | 0.025 | 0.031 | bal. |
| A10 | 0.56 | 1.45 | 0.94 | 0.85 | 0.10 | 0.20 | 0.024 | 0.025 | bal. |
| B1 | 0.63 | 0.67 | 1.06 | 0.26 | 0.20 | — | — | 0.004 | bal. |

TABLE 1-continued

| Sample | Composition (wt. %) | | | | | | | | |
|---|---|---|---|---|---|---|---|---|---|
| No. | C | Si | Mn | Cr | Mo | V | Nb | Al | Fe |
| B2 | 0.64 | 0.59 | 1.03 | 0.26 | 0.20 | 0.10 | 0.022 | 0.017 | bal. |
| B3 | 0.61 | 1.43 | 0.93 | — | 0.20 | — | — | 0.034 | bal. |
| B4 | 0.61 | 1.37 | 0.92 | — | 0.20 | 0.10 | 0.023 | 0.020 | bal. |
| B5 | 0.62 | 0.13 | 1.49 | 0.99 | 0.30 | — | — | 0.021 | bal. |
| B6 | 0.63 | 0.16 | 1.54 | 1.01 | 0.30 | 0.10 | 0.024 | 0.013 | bal. |
| B7 | 0.63 | 0.19 | 2.09 | — | 0.30 | — | — | 0.015 | bal. |
| B8 | 0.63 | 0.20 | 2.07 | — | 0.30 | 0.10 | 0.025 | 0.018 | bal. |
| B9 | 0.58 | 1.30 | 0.81 | 0.83 | — | — | 0.047 | 0.021 | bal. |
| B10 | 0.65 | 1.75 | 0.82 | 0.15 | — | 0.20 | 0.066 | 0.022 | bal. |
| B11 | 0.60 | 0.99 | 1.40 | 0.28 | 0.20 | 0.15 | 0.024 | 0.031 | bal. |
| B12 | 0.57 | 1.50 | 0.77 | 0.72 | — | — | — | 0.003 | bal. |
| B13 | 0.57 | 1.53 | 0.80 | 0.73 | — | 0.19 | 0.022 | 0.024 | bal. |
| B14 | 0.56 | 1.44 | 0.51 | 0.83 | — | 0.19 | 0.025 | 0.037 | bal. |
| B15 | 0.60 | 1.50 | 0.40 | 0.55 | — | — | — | 0.033 | bal. |
| B16 | 0.63 | 1.47 | 0.42 | 0.57 | — | 0.20 | — | 0.029 | bal. |
| B17 | 0.61 | 0.86 | 0.79 | 0.50 | — | — | — | 0.031 | bal. |
| B18 | 0.55 | 1.42 | 0.61 | 0.85 | — | 0.20 | 0.024 | 0.032 | bal. |

Remark:
Nos. A1-A10: Steels of the present Invention
Nos. B1-B18: Comparative Steels Table 2 shows the relationship between the hardness and Charpy impact value for each sample steel, as shown in Table 1, after quenching and tempering at 380 ° C.

TABLE 2

| Mechanical properties | Sample No. of the Present Invention | | | | |
|---|---|---|---|---|---|
| | A1 | A2 | A3 | A4 | A5 |
| Hardness (Hv) | 626 | 656 | 664 | 626 | 641 |
| Charpy impact values (kgf-m/cm$^2$) | 3.9 | 4.0 | 4.3 | 3.5 | 3.7 |
| **Mechanical properties** | **Sample No. of the Present Invention** | | | | |
| | A6 | A7 | A8 | A9 | A10 |
| Hardness (Hv) | 639 | 620 | 644 | 657 | 655 |
| Charpy impact values (kgf-m/cm$^2$) | 4.0 | 3.7 | 3.9 | 3.8 | 3.9 |
| **Mechanical properties** | **Comparative Sample No.** | | | | |
| | B1 | B2 | B3 | B4 | B5 | B6 |
| Hardness (Hv) | 570 | 560 | 600 | 610 | 560 | 560 |
| Charpy impact values (kgf-m/cm$^2$) | 2.6 | 2.9 | 2.9 | 3.1 | 2.9 | 2.8 |
| **Mechanical properties** | **Comparative Sample No.** | | | | | |
| | B7 | B8 | B9 | B10 | B11 | B12 |
| Hardness (Hv) | 530 | 540 | 590 | 642 | 590 | 611 |
| Charpy impact values (kgf-m/cm$^2$) | 2.6 | 2.8 | 2.8 | 2.6 | 3.1 | 3.0 |
| **Mechanical properties** | **Comparative Sample No.** | | | | | |
| | B13 | B14 | B15 | B16 | B17 | B18 |
| Hardness (Hv) | 614 | 613 | 590 | 644 | 573 | 629 |
| Charpy impact values (kgf-m/cm$^2$) | 3.1 | 3.1 | 2.8 | 2.9 | 3.2 | 3.0 |

Figure 2:
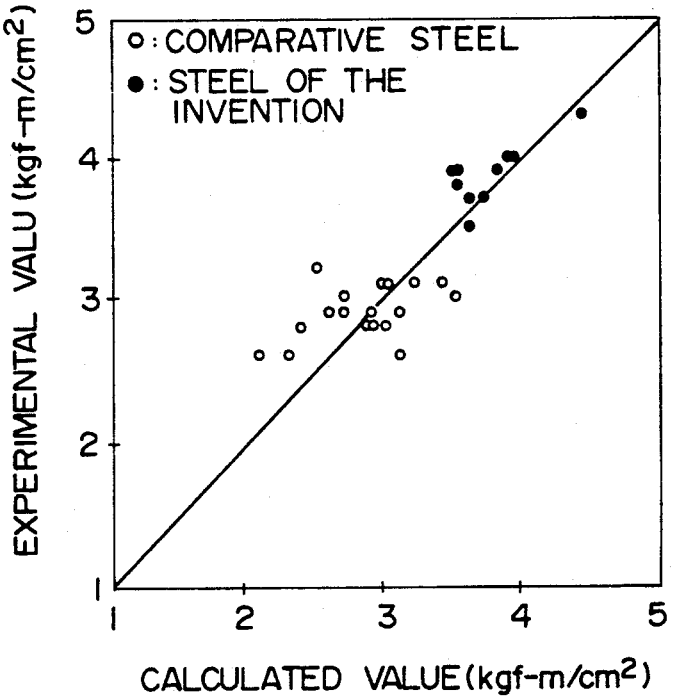
FIG. 2 is a graph showing the relationship between the calculated values and experimental values for the toughness of sample steels.

FIGS. 1 and 2 are graphs diagrammatically showing the relationship between the test results shown in Table 2 and values calculated from Equations (1*a*) and (1*b*) and (2*a*) and (2*b*). It can be seen from Table 2 that the steels of the present invention have higher Charpy impact values than the comparative steels.

Steel ingots were prepared from the inventive steel No. A7 and the comparative steel No. B12, hot-rolled to effect a reduction ratio of at least 50, and hot-formed into sample springs. The resulting springs were subjected to quenching, tempering, shot-peening and setting to provide sample springs. Table 3 shows particulars of the sample springs. The hardness values of the springs were adjusted to Hv 620 for the inventive steel and Hv 530 for the comparative steel.

TABLE 3

| | |
|---|---|
| Diameter of wire (mm) | 11.0 |
| Mean diameter of coil (mm) | 110 |
| Total No. of turns | 5.5 |
| Effective No. of turns | 4.0 |

Each sample spring was subjected to a fatigue test. The results are shown in Table 4.

TABLE 4

| | Applied Stress (kgf/mm$^2$) | Number of Cycles to Failure ($\times 10^4$) |
|---|---|---|
| Steel of the Invention | 10–120 | 27.9 28.4 28.8<br>30.1 30.5 34.3 |
| Comparative Steel | 10–110 | 25.6, 26.8, 29.3,<br>30.7, 32.5, 33.8 |

It will be seen from Table 4 that the steel of the present invention can guarantee a long useful life equivalent to that of the comparative steel, even if the steel of the present invention is placed under a higher stress condition than the comparative spring steel.

Table 5 shows the results of a sag test for the same sample springs prepared from the inventive steel No. A17 and the comparative steel No. B12.

TABLE 5

| | Applied Stress (kgf/mm$^2$) | Sagging Properties (Residual Shear Strain) |
|---|---|---|
| Steel of the Invention | 120 | $6.0 \times 10^{-4}$ |
| Conventional Steel | 110 | $6.2 \times 10^{-4}$ |

Remark:
Test Conditions: 80° C. × 96 hours

The test results showed that the inventive steel spring could ensure a high sag resistance equivalent to that of the comparative steel, nevertheless it was placed in a higher stress condition than the comparative steel. Such results show that the steel of the present invention is a high strength spring steel which can be formed into springs to be used under application of stresses higher than that may be applied to the comparative spring steel. In the steel of the present invention, it is possible to increase the strength or hardness to a much higher level than heretofore available while maintaining the Charpy impact value at a high level. Therefore, a high reliability can be ensured in the resulting spring products.

EXAMPLES 2

Table 4 shows the chemical compositions of further sample steels.

TABLE 6

| Sample | Chemical Composition (wt. %) | | | | | | | | |
|---|---|---|---|---|---|---|---|---|---|
| No. | C | Si | Mn | Cr | Mo | V | Nb | Al | Fe |
| A11 | 0.57 | 1.47 | 0.45 | 0.84 | 0.11 | 0.19 | 0.026 | 0.050 | bal. |
| A12 | 0.57 | 2.00 | 0.49 | 0.85 | 0.11 | 0.20 | 0.023 | 0.036 | bal. |
| A13 | 0.57 | 2.48 | 0.48 | 0.84 | 0.27 | 0.20 | 0.024 | 0.034 | bal. |
| A14 | 0.55 | 1.49 | 0.43 | 0.81 | 0.05 | 0.20 | 0.022 | 0.040 | bal. |
| A15 | 0.60 | 1.27 | 0.49 | 0.83 | 0.15 | 0.20 | 0.022 | 0.046 | bal. |
| A16 | 0.54 | 1.49 | 0.47 | 1.82 | 0.19 | 0.20 | 0.024 | 0.041 | bal. |
| A17 | 0.54 | 1.56 | 0.45 | 0.83 | 0.11 | 0.20 | 0.023 | 0.021 | bal. |

Remark:
Nos. A11–A17: Steels of the present Invention

Table 7 shows the relationship between the hardness and Charpy impact value for each sample steel, as shown in Table 6, after quenching and tempering at 400° C., in comparison with the comparative sample steels as shown in Table 1.

TABLE 7

| Mechanical properties | Comparative Sample No. | | | | | |
|---|---|---|---|---|---|---|
| | B1 | B2 | B3 | B4 | B5 | B6 |
| Hardness (Hv) | 543 | 542 | 587 | 594 | 555 | 554 |
| Charpy impact values (kgf-m/cm$^2$) | 3.0 | 3.0 | 3.1 | 3.2 | 2.9 | 2.9 |
| **Mechanical properties** | **Comparative Sample No.** | | | | | |
| | B7 | B8 | B9 | B10 | B11 | B12 |
| Hardness (Hv) | 528 | 534 | 581 | 611 | 577 | 572 |
| Charpy impact values (kgf-m/cm$^2$) | 2.8 | 3.0 | 3.1 | 2.5 | 3.3 | 3.1 |
| **Mechanical properties** | **Comparative Sample No.** | | | | | |
| | B13 | B14 | B15 | B16 | B17 | B18 |
| Hardness (Hv) | 592 | 579 | 571 | 605 | 543 | 592 |
| Charpy impact values (kgf-m/cm$^2$) | 3.0 | 3.2 | 3.1 | 3.2 | 3.0 | 3.3 |
| **Mechanical properties** | **Sample No. of the Present Invention** | | | | | |
| | A11 | A12 | A13 | A14 | A15 | A16 | A17 |
| Hardness (Hv) | 593 | 637 | 651 | 596 | 605 | 612 | 601 |
| Charpy impact values (kgf-m/cm$^2$) | 4.0 | 4.1 | 4.0 | 3.8 | 3.9 | 4.0 | 4.1 |

It can be seen from Table 7 that the steels of the present invention have higher Charpy impact values than comparative steels.

Steel ingots were prepared from the inventive steel No. A17 and the comparative steel No. B12, hot-rolled to effect a reduction ratio of at least 50, and hot-formed into sample springs. The resulting springs were subjected to quenching, tempering, shot-peening and setting.

Table 8 shows particulars of the sample springs. The hardness values of the springs were adjusted to Hv 580 for the inventive steel and Hv 530 for the comparative steel.

TABLE 8

| | |
|---|---|
| Diameter of wire (mm) | 11.0 |
| Mean diameter of coil (mm) | 110 |
| Total No. of turns | 5.5 |
| Effective No. of turns | 4.0 |

Each spring was subjected to a fatigue test. The results are shown in Table 9. It will be seen from Table 9 that the steel of the present invention can guarantee a long useful life equivalent to that of the conventional steel, even if the steel of the present invention is placed under a higher stress condition than the comparative spring steel.

TABLE 9

| | Applied Stress (kgf/mm$^2$) | Number of Cycles to Failure ($\times 10^{-4}$) |
|---|---|---|
| Steel of the Invention | 10–120 | 27.6 28.5 28.7<br>29.8 30.4 35.2 |
| Comparative Steel | 10–110 | 25.6, 26.8, 29.3,<br>30.7, 32.5, 33.8 |

Table 10 shows the results of a sag test for the same sample springs prepared from the inventive steel No. A17 and the comparative steel No. B12.

The test results show that the inventive steel spring can ensure a high sag resistance which is equivalent to that of the conventional steel, even if it is placed in a higher stress condition than the comparative steel. Such results show that the steel of the present invention is a high strength spring steel which can be formed into a spring to be used under application of stress higher than that may be applied to the comparative spring steel. In the steel of the present invention, it is possible to increase the strength and hardness to a much higher level than heretofore available while maintaining the Charpy impact value at a high level. Therefore, a high reliability can be ensured in the resulting spring products.

TABLE 10

| | Applied Stress ($kgf/mm^2$) | Sagging Properties (Residual Shear Strain) |
|---|---|---|
| Steel of the Invention | 120 | $6.0 \times 10^{-4}$ |
| Conventional Steel | 110 | $6.2 \times 10^{-4}$ |

Remark:
Test Conditions: 80° C. × 96 hours

As described above, the steel of the present invention is a high strength spring steel and, when it is used for preparation of springs, the resultant springs exhibit a good durability and have a long useful life and a high sag resistance. Accordingly, the inventive steel produces outstanding effects in cars or practical services in various industrial machines.

We claim:

1. A high strength spring steel consisting of, in weight percentage, 0.50 to 0.70% C, 1.00 to 2.50% Si, 0.30 to 1.20% Mn, 0.80 to less than 1.20% Cr, 0.05 to 0.30% Mo, 0.05 to 0.30% V, 0.01 to 0.30% Nb, 0.005 to 0.100% Al and the balance being Fe and unavoidable impurities.

* * * * *